US008917069B2

(12) United States Patent
Howes et al.

(10) Patent No.: US 8,917,069 B2
(45) Date of Patent: Dec. 23, 2014

(54) LOW DROP-OUT VOLTAGE REGULATOR WITH DYNAMIC VOLTAGE CONTROL

(75) Inventors: Rupert Howes, Streud (GB); Alexandre Tavares, Swindon (GB); Anthony Clowes, Swindon (GB); Mark Childs, Wilts (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 833 days.

(21) Appl. No.: 13/134,603

(22) Filed: Jun. 10, 2011

(65) Prior Publication Data

US 2012/0299564 A1 Nov. 29, 2012

(30) Foreign Application Priority Data

May 25, 2011 (EP) ..... 11392004

(51) Int. Cl.
*G05F 1/563* (2006.01)
*G05F 1/565* (2006.01)
*G05F 1/575* (2006.01)

(52) U.S. Cl.
CPC ..... *G05F 1/575* (2013.01)
USPC ..... 323/266; 323/275; 323/280; 323/281

(58) Field of Classification Search
USPC ..... 323/266, 273, 275, 280, 281, 349
See application file for complete search history.

(56) References Cited

U.S. PATENT DOCUMENTS 6,031,362 A 2/2000 Bradley
6,246,221 B1 6/2001 Xi
6,304,131 B1 10/2001 Huggins et al.
6,340,918 B2 1/2002 Taylor
6,856,124 B2 2/2005 Dearn et al.
6,900,621 B1 * 5/2005 Gunther ..... 323/266
7,030,598 B1 4/2006 Dow
7,459,891 B2 12/2008 Al-Shyoukh et al.
7,619,402 B1 11/2009 Kwong
7,893,672 B2 2/2011 Scoones et al.

(Continued)

FOREIGN PATENT DOCUMENTS

EP 0 742 509 11/1996
EP 2 151 732 2/2010

OTHER PUBLICATIONS

European Search Report 11392004.5—2206/2533126 Maile date—Nov. 14, 2012.

(Continued)

*Primary Examiner* — Fred E Finch, III
(74) *Attorney, Agent, or Firm* — Saile Ackerman LLC; Stephen B. Ackerman; Billy Knowles

(57) ABSTRACT

A low dropout voltage regulator circuit that dynamically adjusts its output voltage has a voltage adjustment circuit in communication with a dynamic voltage controlling circuit for modifying the output voltage of the low dropout voltage regulator. A first amplification circuit is connected to receive an adjusted reference voltage from the voltage adjustment circuit and compare it with a feedback signal from the output voltage to provide a drive signal to a signal input terminal of a follower output transistor. An output terminal of the follower output transistor provides the output voltage of the regulation circuit. An adjustable internal load circuit applies a load current to the output terminal of the follower output transistor to increase the bandwidth of the output of the voltage regulation circuit that is sensed by a dynamic biasing sensing circuit to generate a dynamic biasing signal that modifies the bandwidth of the first amplification circuit.

38 Claims, 4 Drawing Sheets

(56) References Cited

U.S. PATENT DOCUMENTS

| | | | | |
|---|---|---|---|---|
| 8,471,539 | B2 * | 6/2013 | Wu | 323/275 |
| 2002/0171403 | A1 * | 11/2002 | Lopata | 323/280 |
| 2003/0178976 | A1 * | 9/2003 | Xi | 323/273 |
| 2007/0159146 | A1 * | 7/2007 | Mandal | 323/280 |
| 2008/0116866 | A1 | 5/2008 | Tsai | |
| 2008/0122416 | A1 | 5/2008 | Cowell et al. | |
| 2008/0218139 | A1 * | 9/2008 | Takagi | 323/280 |
| 2010/0079121 | A1 * | 4/2010 | Yanagawa | 323/277 |
| 2010/0148708 | A1 | 6/2010 | Jorgenson et al. | |
| 2010/0237839 | A1 | 9/2010 | Gurcan | |
| 2011/0181257 | A1 * | 7/2011 | Pancholi et al. | 323/280 |
| 2012/0187927 | A1 * | 7/2012 | Yu et al. | 323/271 |
| 2012/0262138 | A1 * | 10/2012 | Srinivasan et al. | 323/279 |

OTHER PUBLICATIONS

"A Fast-Recovery Low Dropout Linear Regulator for Any-Type Output Capacitors," by Sao-Hung Lu et al., Asian Solid-State Circuits Conference, 2005, IEEE, PI, Nov. 1, 2005, pp. 497-800, XP031019853.

"A WCDMA HBT Power Amplifier Module with Integrated Si DC Power Management IC for Current Reduction under Backoff Operation," by Gary Hau et al., 2007 IEEE Radio Frequency Integrated Circuits Symposium, Piscataway, NJ, USA, Jun. 1, 2007, pp. 75-78, XP031112983.

"Inductor-Free Low Power Step-Down DC-DC Switching Voltage Converter," by Chun-Hsun Wu et al., Industrial Electronics and Applications, 2008, ICIEA 2008, 3rd IEEE Conference, Jun. 3-5, 2008, pp. 411-416, 978-1-4244-1717-9.

"Advanced Control Design for Voltage Scaling Converters," by Carolina Albea et al., 2008 IEEE, 978-1-4244-1766-7/08, pp. 79-84.

"Low-Dropout On-Chip Voltage Regulator for Low-Power Circuits," by H. J. Shin et al., 1994 IEEE Symposium on Low Power Electronics, 0-7803-1953-2 / 94, pp. 76-77.

* cited by examiner

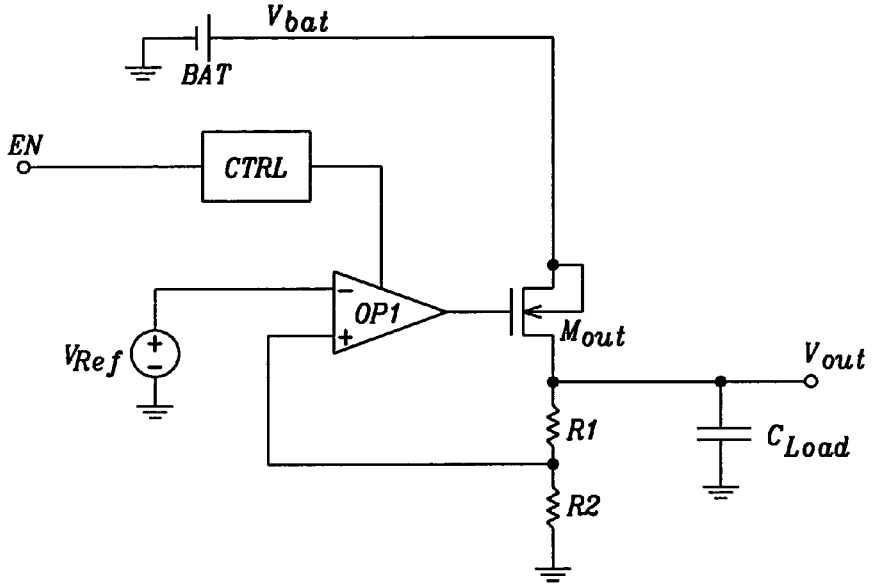
FIG. 1 – Prior Art
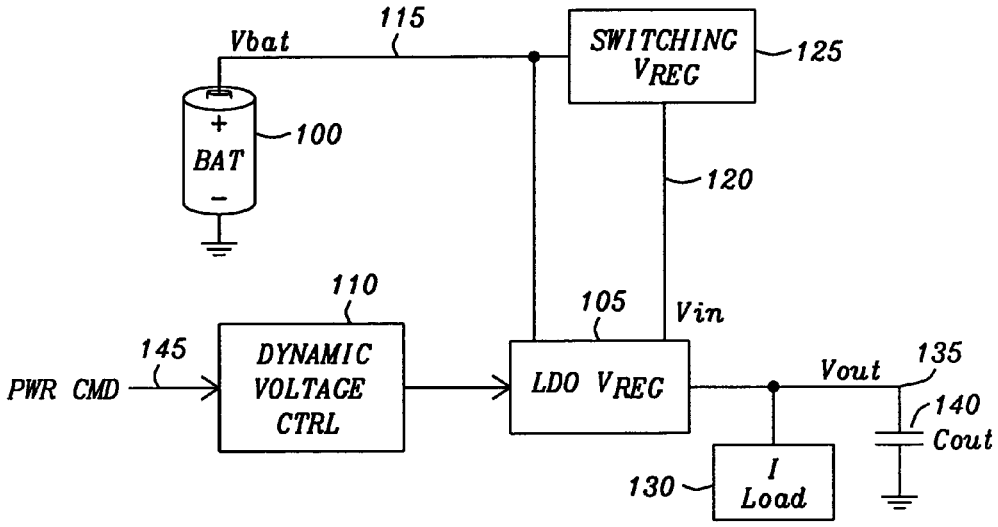
FIG. 2

LOW DROP-OUT VOLTAGE REGULATOR WITH DYNAMIC VOLTAGE CONTROL

RELATED PATENT APPLICATIONS

U.S. patent application Ser. No. 10/191,491, filed on Jul. 9, 2002, issued as U.S. Pat. No. 6,856,124 (Dearn, et al.), Feb. 15, 2005, assigned to the same assignee as the present invention, and incorporated herein by reference in its entirety.

BACKGROUND OF THE INVENTION

1. Field of the Invention

This invention relates generally to voltage regulator circuits. More particularly, this invention relates to low dropout voltage regulator circuits. Even more particularly this invention relates to low dropout voltage regulator circuits having dynamic voltage control.

2. Description of Related Art

Battery powered applications such as smart-phones and tablet computers demand long battery life and therefore highly power efficient circuits. Often, the power supply voltage of digital circuits for the battery power applications must be adjusted during operation to minimize power consumption, since the power dissipated is proportional to the square of the power supply voltage. To achieve the required speed of operation, a certain minimum supply voltage is required. As demand fluctuates, so the supply voltage is adjusted as required.

The power supply for these types of circuits is often regulated down from the main battery by a voltage regulator, e.g. buck converter or linear regulator.

Buck regulators are generally power efficient but can consume a significant area and need bulky external components (inductors). These circuits are often used for higher load currents where the area of the control circuit is not significant compared with the size of the power switches.

However, for applications which require only a modest load current, the area penalty of a buck converter may be unacceptable. In such cases, the use of a low dropout voltage regulator (LDO) can be more area efficient although with some loss of energy efficiency.

A low dropout regulator is a class of linear regulator that is designed to minimize the saturation of the output pass transistor and its drive requirements. A low-dropout linear regulator will operate with input voltages only slightly higher than the desired output voltage. FIG. 1 is a schematic of a low dropout voltage regulator of the prior art. The main components of a low dropout voltage regulator are a power field effect transistor $M_{Out}$ having a source and bulk connected to a battery BAT to receive a battery voltage $V_{bat}$. The gate of the power field effect transistor $M_{Out}$ is connected to an output of a differential error amplifier Op1. One input of the differential error amplifier Op1 monitors the fraction of the output determined by the resistor ratio of R1 and R2. The second input to the differential error amplifier Op1 is from a stable voltage reference (bandgap reference) $V_{Ref}$. If the output voltage rises too high relative to the reference voltage $V_{Ref}$, the drive to the power field effect transistor $M_{out}$ changes to maintain a constant output voltage $V_{Out}$ developed across the load capacitance $C_{Load}$.

SUMMARY OF THE INVENTION

An object of this invention is to provide a low dropout voltage regulator circuit that minimizes the power consumption of the load circuit by dynamically adjusting its output voltage.

To accomplish at least this object, a voltage regulation circuit has a voltage adjustment circuit that is in communication with a dynamic voltage controlling circuit for modifying an output voltage of the voltage regulation circuit. In various embodiments, the voltage adjustment circuit is a voltage digital-to-analog converter. A first amplification circuit is connected to receive an adjusted reference voltage from an output of the voltage adjustment circuit. The first amplification circuit is connected to receive an output feedback signal that is proportional to the output voltage of the voltage regulation circuit and from the differential of the adjusted reference voltage and the output feedback generates a voltage drive signal.

An output of the first amplification circuit is in communication with a signal input terminal of a follower output transistor to transfer the voltage drive signal to the follower output transistor. The follower output transistor has an input voltage terminal connected to receive a pre-regulated input supply voltage and an output terminal to provide the output voltage of the regulation circuit that is determined by the voltage to drive signal. The follower output transistor in some embodiments is a metal oxide semiconductor (MOS) field effect transistor (FET) and in other embodiments the follower output transistor is a bipolar transistor. In various embodiments the MOS FET is an N-type MOS FET. In various embodiments the bipolar transistor is an N-type bipolar transistor.

In various embodiments, a dynamic biasing circuit senses a load current through the follower output transistor and generates a dynamic biasing signal that is communicated to the first amplification circuit to modify the bandwidth of the first amplification circuit.

The output terminal of the follower output transistor is in communication with an adjustable internal load circuit. The adjustable internal load circuit is in communication with the dynamic voltage controlling circuits to apply a load current to the output terminal of the follower output transistor to increase the bandwidth of the voltage regulation circuit. The output voltage at the output terminal of the follower output transistor is modified by changing an output voltage level of the voltage adjustment circuit. In some embodiments, when the output voltage has been modified, the adjustable internal load circuit is disabled. In other embodiments, the load current of the adjustable internal load circuit is maintained at a level pending another modification of the output voltage level or a transient change in an external load. In still other embodiments, the load current of the adjustable internal load circuit is maintained at a lower level to conserve energy.

In various embodiments, the load current of the adjustable internal load circuit is a function of an output load capacitance connected to the output terminal of the follower output transistor. In other embodiments the load current of the adjustable internal load circuit is a function of a rate of modification of the output voltage level.

In some embodiments, the output of the first amplification circuit is connected to an input of a second amplification circuit. The input of the second amplification circuit is connected to a first terminal of a coupling capacitor. A second terminal of the coupling capacitor is connected to the output terminal of the follower output transistor to provide a feedback signal to the input of the second amplification circuit.

In various embodiments, an output of the second amplification circuit is connected to a buffer circuit to condition the output voltage level of the voltage adjustment circuit for driving the input terminal of the follower output transistor.

In various embodiments, the voltage regulation circuit is maintained at a quiescent state to conserve energy. When a request to modify the output voltage of the voltage regulation circuit is received, the load current of the adjustable internal load circuit is increased to increase the bandwidth of the voltage regulation circuit. The dynamic voltage controlling circuit commands that the voltage adjustment circuit modify the output voltage of the voltage regulation circuit. The voltage adjustment circuit adjusts the reference voltage to the first input of the first amplification circuit. The output of the first amplification circuit is changed to cause the output terminal of the follower output transistor to change the output voltage of the voltage regulation circuit. The dynamic voltage controlling circuit commands the adjustable internal load circuit to be disabled or to cause the load current of the internal load circuit to be decreased.

In other embodiments, a battery driven power supply includes a dynamic voltage control circuit in communication with external control circuitry to receive power level commands instructing the dynamic voltage control circuit to modify an output voltage level of the battery driven power supply to minimize energy usage from the battery. The dynamic voltage control circuit is in communication with a low drop out voltage regulation circuit to receive voltage level signals developed by the dynamic voltage control circuit from the power level commands. The low dropout voltage regulation circuit dynamically adjusts the output voltage level based on the voltage level signals. The low dropout voltage regulation circuit is connected to the battery. The low dropout voltage regulation circuit is further connected to a switching voltage regulator to provide a pre-regulated input voltage to generate the output voltage level. The switching voltage regulator is connected to the battery to generate the pre-regulated input voltage.

BRIEF DESCRIPTION OF THE DRAWINGS

FIG. 1 is a schematic of a low dropout voltage regulator of the prior art.

FIG. 2 is a block diagram of an embodiment of a battery driven power supply including a low dropout voltage regulator with dynamic voltage control.

DETAILED DESCRIPTION OF THE INVENTION

Figure 3:
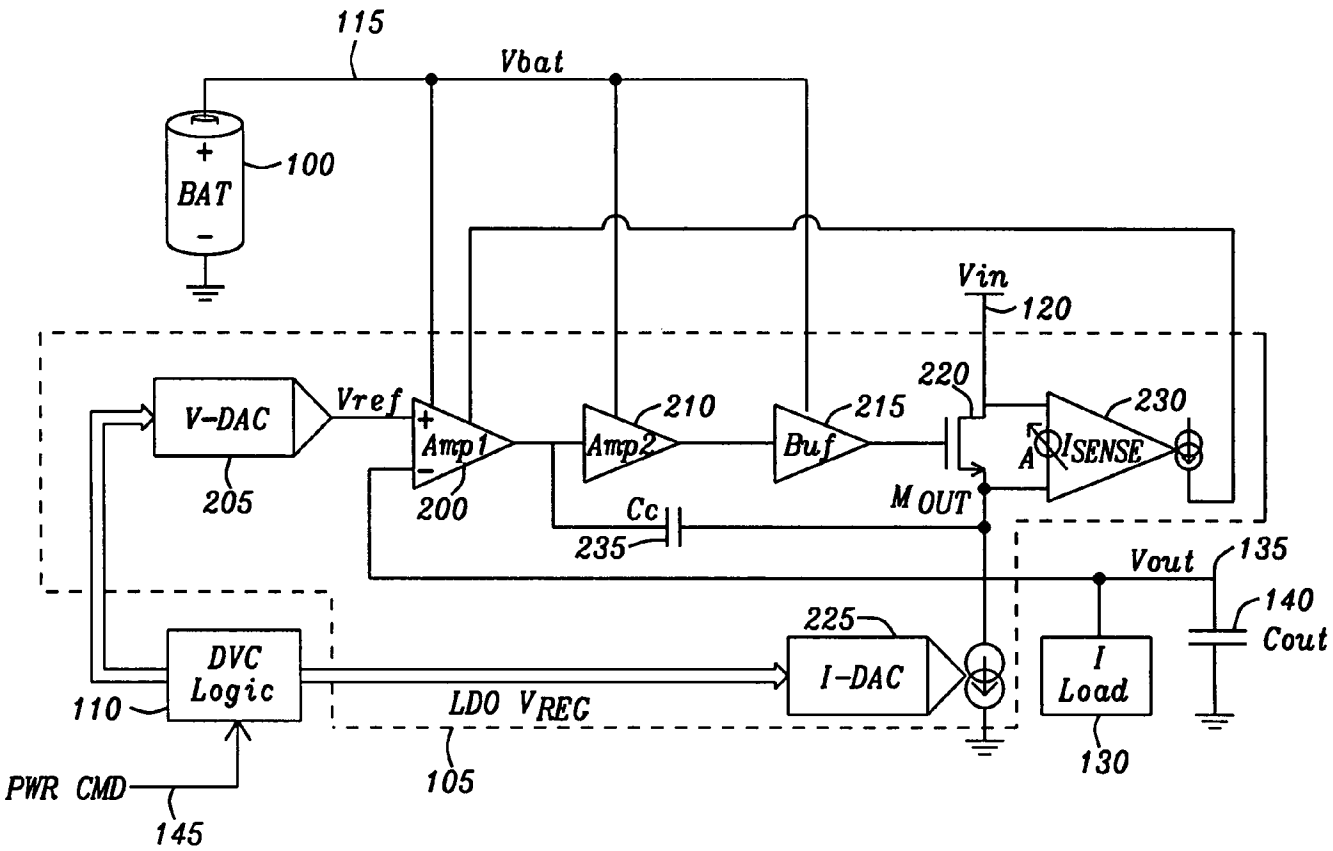
FIG. 3 is a schematic of an embodiment of a low dropout voltage regulator with dynamic voltage control of this invention.

U.S. Pat. No. 6,856,124 (Dearn, et al.) describes a low dropout voltage regulator with wide output load range and fast internal loop. The circuit is internally compensated and uses a capacitor to ensure that the internal pole is more dominant than the output pole as in standard Miller compensation. The quiescent current is set to be proportional to the output load current. No explicit low power drive stage is required. The whole output range is covered by one output drive stage. This means the total consumption of quiescent or wasted current is reduced. An excellent power supply rejection ratio (PSRR) is achieved due to load dependent bias current. Dearn, et al. covers the basic low dropout voltage regulator architecture. However, the low dropout voltage regulator of Dearn, et al. is unable to dynamically change its output voltage.

What is needed is a low dropout voltage regulator circuit in which the output voltage can be dynamically increased or decreased in response to a system request. This increase or decrease must be achieved rapidly. The circuit requires no knowledge of the load current. High efficiency is achieved by using an input voltage which has already been pre-regulated from the battery voltage. For example, the pre-regulated input voltage may be developed by a switching converter which may already be present for other system tasks. This means that the total voltage drop across the linear regulator's output device can be kept small maintaining high power efficiency.

To minimize battery power consumption, the output voltage level of the low-dropout voltage regulation circuit is dynamically adjusted depending on system requirements. To respond to a system request to increase or decrease the output voltage rapidly, which is normally required, the low dropout voltage regulator needs to have a high bandwidth. This requires a high power dissipation. In the prior art, a dynamic bias scheme ensures that the quiescent current of the circuit is kept low and only increases as the load current increases, which ensures the internal circuit bandwidth (poles) track the output bandwidth (pole). It is apparent that a high circuit bandwidth is achieved only with a high output load current.

In most embodiments of this invention, the low dropout regulator does not require the output load current to be a particular value, but the circuit is forced into a high bandwidth state by applying an internal load current which increases the output pole. In various embodiments, the dominant pole of the low dropout regulator is increased via dynamic current sensing. Once this high bandwidth state is reached, the output voltage level is ramped up by changing the reference voltage output from a voltage adjustment circuit such as a voltage digital-to-analog converter. At the end of the adjusting of the output voltage level, the internal load current may be switched off to save power. In some embodiments, the internal load current may be maintained if another adjustment command is expected or a load transient is expected. In other embodiments, the internal load current may be maintained after the end of an adjustment of the output voltage level, but at a lower level. The internal load current for a modification of the output voltage level may be a function of the ramp rate required, the initial ramp voltage, or the end of ramp voltage. In other embodiments, the internal load current may be a function of the load capacitance. In some embodiments, the internal load current could be made a function of the system load current. The system load current is known from dynamic bias sense circuitry.

In various embodiments, the low dropout voltage regulator has a controlled ramp-rate from zero volts to the initial output target voltage during a power initialization by dynamically controlling the voltage adjustment circuit and the internal load current.

In the prior art, the output transistor is a common source or common emitter configured amplifier. The pre-regulating of the input voltage from the battery voltage reduces the gate-to-source (base-to-emitter) drive available to the output transistor. In the embodiments, a follower output transistor (source follower or emitter follower) is configured with a current mirror drive stage. The higher battery supply voltage is used to provide a high drive to the input terminal (gate or base) of the output transistor such that the output transistor maintains its area small.

In some embodiments the output transistor is a source follower configured metal oxide semiconductor (MOS) field effect transistor (FET) or an emitter follower configured bipolar transistor. In various embodiments, the MOS FET is an N-type MOS FET. In other embodiments, the bipolar transistor is an NPN bipolar transistor.

FIG. 2 is a block diagram of an embodiment of a battery 100 driven power supply including a low dropout voltage regulator 105 with dynamic voltage control 110. In the battery powered systems such as the smart-phone or tablet computer, a power controller provides a power command 145 to indicate the voltage level necessary to be applied to circuitry within the system. During inactivity, many of the circuits within the system are disabled and are activated only during usage. On other occasions, some circuitry has the output voltage level 135 decreased to maintain a minimal performance level. When more performance is demanded the output voltage level 135 is increased to meet the demands of the higher performance. The battery 100 is connected to a switching voltage regulator 125. The switching voltage regulator 125 provides a regulated input voltage 120 to a low dropout voltage regulator 105. The battery 100 is connected to the low dropout voltage regulator 105 to provide necessary power to the control circuitry of the low dropout voltage regulator 105. The input voltage 120 from the switching voltage regulator 125 is the voltage applied to the output transistor to generate the output voltage 135 from the low dropout voltage regulator 105. The power command signal 145 is the input to the dynamic voltage control circuit 110. The dynamic voltage control circuit 110 is connected to the low dropout voltage regulator 105 to provide a voltage adjustment signal indicating the voltage level and the rate of change ramping of the output voltage 135. The output voltage 135 is applied to output load capacitor 140 and the output load current source 130.

FIG. 3 is a schematic of an embodiment of a low dropout voltage regulator 105 of FIG. 2. The battery 100 is connected to a first amplifier gain stage 200, a second amplifier gain stage 210, and a buffer stage 215 to provide the high drive to the gate of the NMOS follower output transistor 220 such that the NMOS follower output transistor 220 maintains its small area. The dynamic voltage control circuit receives the power command signal 145 and transmits a voltage adjustment signal to a voltage digital-to-analog converter 205. In various embodiments, the voltage adjustment signal is a digital code that is converted by the voltage digital-to-analog converter 205 to a reference voltage level that is applied to a first input terminal of the first amplifier gain stage 200. A second input terminal of the first amplifier gain stage 200 is connected to the output terminal of the low dropout voltage regulator 105 to receive a slow feedback signal. The slow feed back signal from the output terminal of the low dropout voltage regulator 105 is compared to the reference voltage supplied by the voltage digital-to-analog converter 205 in the first amplifier gain stage 200 to develop a drive signal for the NMOS follower output transistor 220. The output of the first amplifier gain stage 200 is connected to the input of the second amplifier gain stage 210 such that the drive signal is applied to the second amplifier gain stage 210. One terminal of a compensation capacitor 235 is connected to the input of the second amplifier gain stage 210 and the second terminal of the compensation capacitor 235 is connected to the output terminal 135 of the low dropout voltage regulator 105 to receive a fast feedback signal. The drive signal is summed with the fast feedback signal and is appropriately amplified. The amplified drive signal is then applied to the buffer 215.

Figure 5:
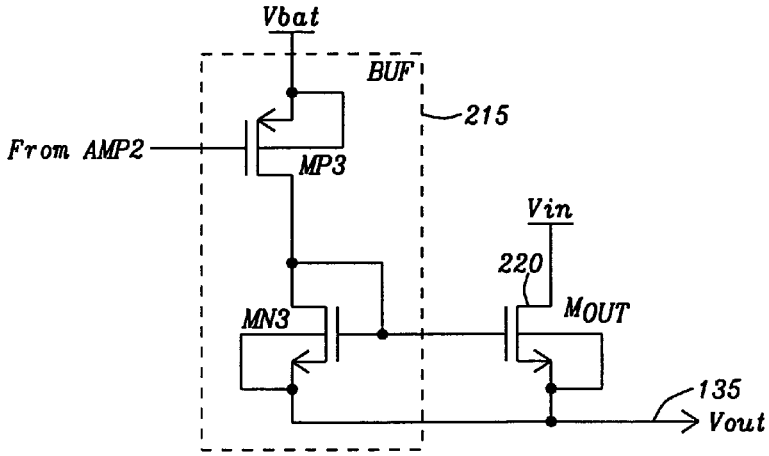
FIG. 5 is a schematic of a buffer stage and the follower output transistor of the embodiments of FIG. 3.

The buffer 215 acts as the current mirror for the NMOS follower output transistor 220. FIG. 5 is a schematic of the buffer stage 215 and the NMOS follower output transistor 220 of the embodiments of FIG. 3. Referring to FIG. 5, the buffer 215 has a PMOS transistor MP3 having is source connected to the battery 100, its gate connected to the output of the second amplifier gain stage 210. The drain of the PMOS transistor MP3 is connected to the gate and drain of the diode connected NMOS transistor MN3 and to the gate of the NMOS output transistor 220. The drive signal from output of the second amplifier gain stage 210 determines the current through the PMOS transistor MP3 and thus the voltage developed across the diode connected NMOS transistor MN3. The voltage developed across the diode connected NMOS transistor MN3 in turn determines the current through the NMOS output transistor 220 and thus the voltage level Vout at the output terminal 135 of the low dropout voltage regulator 105 that is developed across the output load capacitor 140 and the current load 130.

Return now to FIG. 3. In order to rapidly adjust the voltage level Vout at the output terminal 135 of the low dropout voltage regulator 105, the internal bandwidth or dominant pole of the low dropout voltage regulator 105 must be increased. To accomplish this and to make the adjustment of the dominant pole independent of the load current 130, an adjustable internal load current source 225 is connected to the output terminal 135 of the low dropout voltage regulator 105. The dynamic voltage control circuit 110 has an output connected to the adjustable internal load current source 225 to provide a current adjustment control signal. In various embodiments, the current adjustment control signal is a digital code applied to the adjustable internal load current source 225. The adjustable internal load current source 225 is a current digital-to-analog converter that receives the digital code and provides the internal current to the source of the NMOS output transistor 220 to increase the pole of the output of the low dropout voltage regulator 105 and thus to its internal circuitry to allow the rapid adjustment of the output voltage level Vout at the output terminal 135.

The internal current output of the adjustable internal load current source 225 is maintained at a level pending another modification of the output voltage level or a transient change in the external load current 130. In still other embodiments, the load current of the adjustable internal load current source 225 is maintained at a lower level to conserve energy. The load current of the adjustable internal load current source 225 may be a function of the output load capacitance 140. In other embodiments the load current of the adjustable internal load current source 225 is a function of a ramp rate of the modification of the output voltage level.

To minimize the energy consumption from the battery 100, the output voltage level Vout of the low dropout voltage regulator 105 is dynamically adjusted depending on system requirements. To respond to the system request to increase or decrease the output voltage at a fast rate the low dropout voltage regulator 105 needs to have a high bandwidth. To minimize the power dissipation a dynamic bias sensing circuit 230 ensures that the quiescent current of the circuit is kept low and only increases as the load current increases. This ensures the internal circuit poles track the output pole. To accomplish this, the dynamic bias sensing circuit 230 senses the current flowing through the NMOS output transistor 220 and modifies the current applied from the battery 100 to the first amplifier gain stage 200.

Figure 4:
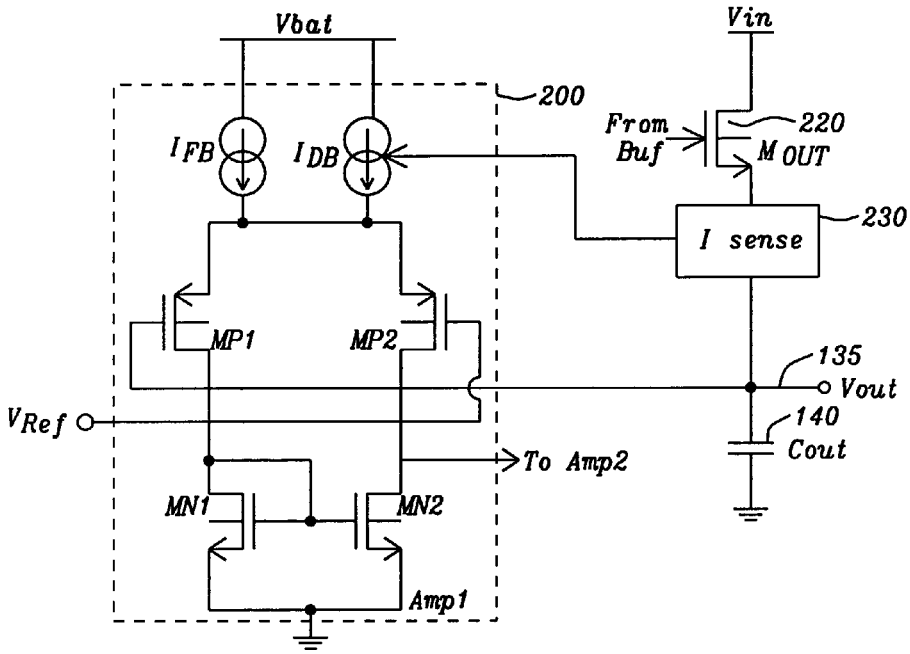
FIG. 4 is a schematic of a first amplification stage and the dynamic biasing circuit of the embodiments of FIG. 3.

FIG. 4 is a schematic of the first amplifier gain stage 200 and the dynamic biasing sensing circuit 230 of FIG. 3. Referring to FIG. 4, the first amplifier gain stage 200 has a pair of PMOS transistors MP1 and MP2 having their sources commonly connected to the fixed bias current source $I_{FB}$ and the dynamic bias current source $I_{DB}$. The fixed bias current source $I_{FB}$ and the dynamic bias current source $I_{DB}$ are connected to the battery to receive the battery voltage Vbat. The gate of the PMOS transistor MP1 is connected to the output terminal 135 and the gate of the PMOS transistor MP2 is connected to the reference voltage $V_{ref}$ from the output of the voltage digital-to-analog circuit 205 of FIG. 3. It will be apparent to a person skilled in the art that other configurations of the first amplifier gain stage 200 are possible, eg using bipolar junction transistors or using a different circuit architecture and still be in keeping with intent of this invention.

The drain of the PMOS transistor MP1 is connected to the diode connected load NMOS transistor MN1. The drain of the PMOS transistor MP2 is connected to the load NMOS transistor MN2. The gates of the NMOS transistor MN1 and the NMOS transistor MN2 are connected together and to the drain of the PMOS transistor MP1. The sources of the NMOS transistor MN1 and NMOS transistor MN2 are connected to the ground reference voltage. The drains of the PMOS transistor MP2 and the NMOS transistor MN2 are connected to the input of the second amplifier gain stage 210 of FIG. 3. The dynamic bias current sense circuit 230 is connected to sense the load current of the low dropout voltage regulator 105 that flows through the NMOS output transistor 220. The dynamic bias current sense circuit 230 provides a feed back signal that is a function of the load current to adjust the dynamic bias current source $I_{DB}$. The dynamic bias current source $I_{DB}$ is increased when the load current increases to force an increase in the current provided to the NMOS output transistor 220 and to increase the internal poles of the low dropout voltage regulator 105 to allow rapid adjustment of the output voltage Vout at the output terminal 135.

The embodiments of the low dropout voltage regulator 105 as shown are adjusted by activating the adjustable internal load current source 225. The dynamic biasing sensing circuit 230 senses the change in the current flowing through the NMOS output transistor 220 and adjusts the dynamic bias current source $I_{DB}$ of the first amplifier gain stage 200 to increase the bandwidth of the first amplifier gain stage 200. The dynamic voltage control 110 adjusts the voltage digital-to-analog converter 205. The output of the first amplifier gain stage 200 adjusts the drive signal for the NMOS output transistor 220 to adjust the output voltage Vout at the output terminal 135 of the low dropout voltage regulator 105.

Figure 6:
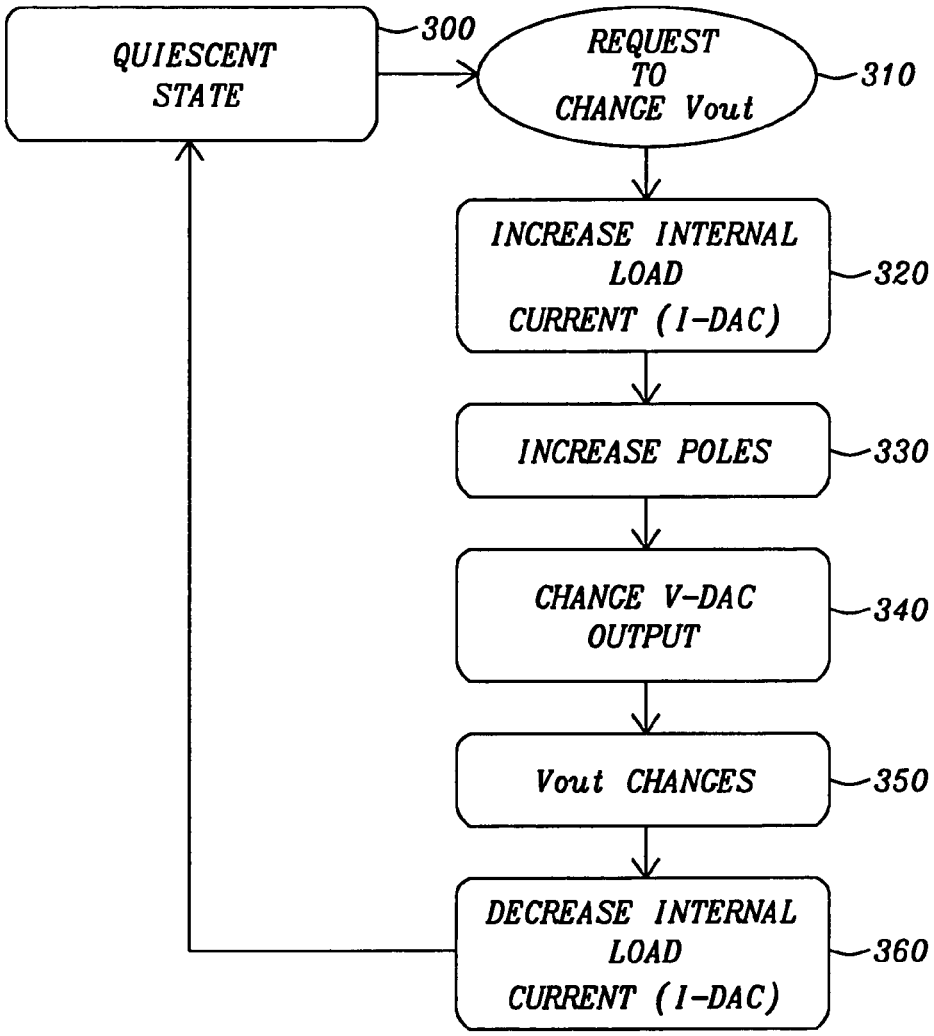
FIG. 6 is a flow chart of the operation of various embodiments of the voltage regulation circuit of this invention.

FIG. 6 is a flow chart of the operation of a low dropout voltage regulation circuit of this invention. The low dropout voltage regulation circuit is placed (Box 300) in a quiescent state where the required voltages are applied to the operating circuits and the non-operating circuits are disabled. When an operating circuit is disabled or a non-operating circuit is enabled, a request (Box 310) for an appropriate change to output voltage level Vout is made. An adjustable internal load current source is activated (Box 320) to increase the internal load current. The internal load current is sensed and the internal bandwidth or poles of the low dropout voltage regulation circuit are increased (Box 330). The voltage adjustment circuit (Voltage digital-to-analog converter) is changed (Box 340) to cause a change to the drive signal of the NMOS output transistor and causing a change (Box 350) to the voltage level of the output voltage Vout of the low dropout voltage regulation circuit. At the completion of the adjustment of the output voltage Vout of the low dropout voltage regulation circuit, the internal load current is decreased (Box 360) and the low dropout voltage regulation circuit assumes the quiescent state (Box 300).

While this invention has been particularly shown and described with reference to the preferred embodiments thereof, it will be understood by those skilled in the art that various changes in form and details may be made without departing from the spirit and scope of the invention.

The invention claimed is:

1. A battery powered apparatus comprising:

a low dropout voltage regulation circuit connected to the battery comprising:

a differential comparison circuit having a first input terminal connected to receive an adjustable reference voltage, a second input terminal connected to receive an output feedback signal from an output of the low dropout voltage regulation circuit, and an output terminal to provide a drive signal indicative of the difference between the adjustable reference voltage signal and the output feedback signal;

a follower drive transistor having an input terminal in communication with the differential comparison circuit to receive the drive signal and a follower terminal connected to the output terminal of the low dropout voltage regulation circuit to provide the output voltage and current to a load circuit of the battery power apparatus;

an adjustable internal current source connected to the output terminal of the low dropout voltage regulation circuit to provide a current for increasing a pole of the output of the low dropout voltage regulation circuit;

a voltage adjustment circuit in communication with the differential comparison circuit to modify the adjustable reference voltage to change the output voltage at the output terminal of the low dropout voltage regulation circuit; and a current sense circuit connected to sense the output current that is passed through the follower drive transistor and in communication with the differential comparison circuit to transfer an output current sense signal to increase an internal pole of the low dropout voltage regulation circuit to permit rapid changes in the output voltage with changes to the adjustable reference voltage.

2. The battery powered apparatus of claim 1 further comprising a dynamic voltage control circuit connected to receive power commands to modify the output voltage of the low dropout voltage regulation circuit.

3. The battery powered apparatus of claim 2 wherein the dynamic voltage control circuit is in communication with the voltage adjustment circuit to transmit a voltage adjust command to the voltage adjustment circuit to modify the adjustable reference voltage.

4. The battery powered apparatus of claim 2 where the dynamic voltage control circuit is in communication with the adjustable internal current source to provide a current adjust command to modify the adjustable current source to provide the current for increasing a pole of the output of the low dropout voltage regulation circuit.

5. The battery powered apparatus of claim 3 wherein the voltage adjustment circuit is a voltage digital-to-analog converter and the voltage adjust command is a digital code representing the voltage level of the adjustable reference voltage.

6. The battery powered apparatus of claim 4 wherein the adjustable internal current source is a current digital-to-analog converter and the current adjust command is a digital code representing the current level of the adjustable internal current source.

7. The battery powered apparatus of claim 1 wherein the follower drive transistor is an MOS FET.

8. The battery powered apparatus of claim 7 wherein the follower drive transistor is an N-type MOS FET.

9. The battery powered apparatus of claim 1 wherein the differential comparison circuit comprises a fixed current source and a dynamically adjustable current source, wherein the dynamically adjustable current source is connected to the current sense circuit to receive the output current sense signal and modify the current through the dynamically adjustable current source as a function of the output current.

10. The battery powered apparatus of claim 1 wherein the low dropout voltage regulation circuit further comprises:

a gain amplification stage having an input connected to the output of the differential comparison circuit for amplifying the drive signal; and a fast feedback coupling capacitor having a first terminal connected to the input of the gain amplification stage and a second terminal connected to the output terminal of the low dropout voltage regulation circuit to feed back changes in the output voltage level of the low dropout voltage regulation circuit to the input of the gain amplification stage.

11. The battery powered apparatus of claim 10 wherein the low dropout voltage regulation circuit further comprises a buffer circuit having an input connected to the output of the gain amplification stage and an output connected to the input terminal of the follower drive transistor to condition the amplified drive signal and to provide a current mirror for the follower drive transistor.

12. The battery powered apparatus of claim 10 wherein the follower drive transistor has a common supply terminal connected to a pre-regulated voltage source for providing power to the follower drive transistor.

13. A battery driven power supply comprising:

a dynamic voltage control circuit in communication with external control circuitry to receive power level commands instructing the dynamic voltage control circuit to modify an output voltage level of the battery driven power supply to minimize energy usage from the battery; and a low dropout voltage regulation circuit in communication with the dynamic voltage control circuit to receive voltage level signals developed by the dynamic voltage control circuit from the power level commands for dynamically adjusting the output voltage level based on the voltage level signals, comprising:

a differential comparison circuit having a first input terminal connected to receive an adjustable reference voltage, a second input terminal connected to receive an output feedback signal from an output of the low dropout voltage regulation circuit, and an output terminal to provide a drive signal indicative of the difference between the adjustable reference voltage signal and the output feedback signal, a follower drive transistor having an input terminal in communication with the differential comparison circuit to receive the drive signal and a follower terminal connected to the output terminal of the low dropout voltage regulation circuit to provide the output voltage and current to a load circuit of the battery power apparatus;

an adjustable internal current source connected to the output terminal of the low dropout voltage regulation circuit to provide a current for increasing a pole of the output of the low dropout voltage regulation circuit, a voltage adjustment circuit in communication with the differential comparison circuit to modify the adjustable reference voltage to change the output voltage at the output terminal of the low dropout voltage regulation circuit, and a current sense circuit connected to sense the output current that is passed through the follower drive transistor and in communication with the differential comparison circuit to transfer an output current sense signal to increase an internal pole of the low dropout voltage regulation circuit to permit rapid changes in the output voltage with changes to the adjustable reference voltage.

14. The battery driven power supply of claim 13 further comprising a switching voltage regulator having an input connected to the battery and output connected to the low dropout voltage regulation circuit to provide a pre-regulated input voltage for generation of the output voltage level.

15. The battery driven power supply of claim 13 wherein the dynamic voltage control circuit is in communication with the voltage adjustment circuit to transmit a voltage adjust command to the voltage adjustment circuit to modify the adjustable reference voltage.

16. The battery driven power supply of claim 15 wherein the voltage adjustment circuit is a voltage digital-to-analog converter and the voltage adjust command is a digital code representing the voltage level of the adjustable reference voltage.

17. The battery driven power supply of claim 13 where the dynamic voltage control circuit is in communication with the adjustable internal current source to provide a current adjust command to modify the adjustable current source to provide the current for increasing a pole of the output of the low dropout voltage regulation circuit.

18. The battery driven power supply of claim 17 wherein the adjustable internal current source is a current digital-to-analog converter and the current adjust command is a digital code representing the current level of the adjustable internal current source.

19. The battery driven power supply of claim 13 wherein the follower drive transistor is an MOS FET.

20. The battery driven power supply of claim 19 wherein the follower drive transistor is an N-type MOS FET.

21. The battery driven power supply of claim 13 wherein the differential comparison circuit comprises a fixed current source and a dynamically adjustable current source, wherein the dynamically adjustable current source is connected to the current sense circuit to receive the output current sense signal and modify the current through the dynamically adjustable current source as a function of the output current.

22. The battery driven power supply of claim 13 wherein in the low dropout voltage regulation circuit further comprises:

a gain amplification stage having an input connected to the output of the differential comparison circuit for amplifying the drive signal; and a fast feedback coupling capacitor having a first terminal connected to the input of the gain amplification stage and a second terminal connected to the output terminal of the low dropout voltage regulation circuit to feed back changes in the output voltage level of the low dropout voltage regulation circuit to the input of the gain amplification stage.

23. The battery driven power supply of claim 22 wherein the low dropout voltage regulation circuit further comprises a buffer circuit having an input connected to the output of the gain amplification stage and an output connected to the input terminal of the follower drive transistor to condition the amplified drive signal and to provide a current mirror for the follower drive transistor.

24. The battery driven power supply of claim 13 wherein the follower drive transistor has a common supply terminal connected to a pre-regulated voltage source for providing power to the follower drive transistor.

25. A low dropout voltage regulation circuit connected to a battery comprising:

a differential comparison circuit having a first input terminal connected to receive an adjustable reference voltage, a second input terminal connected to receive an output feedback signal from an output of the low dropout voltage regulation circuit, and an output to provide a drive signal indicative of the difference between the adjustable reference voltage signal and the output feedback signal;

a follower drive transistor having an input terminal in communication with the differential comparison circuit to receive the drive signal and a follower terminal connected to the output terminal of the low dropout voltage regulation circuit to provide the output voltage and current to a load circuit of the battery power apparatus;

an adjustable internal current source connected to the output terminal of the low dropout voltage regulation circuit to provide a current for increasing a pole of the output of the low dropout voltage regulation circuit;

a voltage adjustment circuit in communication with the differential comparison circuit to modify the adjustable reference voltage to change the output voltage at the output terminal of the low dropout voltage regulation circuit; and a current sense circuit connected to sense the output current that is passed through the follower drive transistor and in communication with the differential comparison circuit to transfer an output current sense signal to increase an internal pole of the low dropout voltage regulation circuit to permit rapid changes in the output voltage with changes to the adjustable reference voltage.

26. The low dropout voltage regulation circuit of claim 25 wherein a dynamic voltage control circuit connected to receive power commands and connected to the voltage adjustment circuit and the adjustable internal current source to modify the output voltage of the low dropout voltage regulation circuit.

27. The low dropout voltage regulation circuit of claim 26 wherein the dynamic voltage control circuit is in communication with the voltage adjustment circuit to transmit a voltage adjust command to the voltage adjustment circuit to modify the adjustable reference voltage.

28. The low dropout voltage regulation circuit of claim 27 where the dynamic voltage control circuit is in communication with the adjustable internal current source to provide a current adjust command to modify the adjustable current source to provide the current for increasing a pole of the output of the low dropout voltage regulation circuit.

29. The low dropout voltage regulation circuit of claim 28 wherein the voltage adjustment circuit is a voltage digital-to-analog converter and the voltage adjust command is a digital code representing the voltage level of the adjustable reference voltage.

30. The low dropout voltage regulation circuit of claim 29 wherein the adjustable internal current source is a current digital-to-analog converter and the current adjust command is a digital code representing the current level of the adjustable internal current source.

31. The low dropout voltage regulation circuit of claim 25 wherein the follower drive transistor is an MOS FET.

32. The low dropout voltage regulation circuit of claim 31 wherein the follower drive transistor is an N-type MOS FET.

33. The low dropout voltage regulation circuit of claim 25 wherein the differential comparison circuit comprises a fixed current source and a dynamically adjustable current source, wherein the dynamically adjustable current source is connected to the current sense circuit to receive the output current sense signal and modify the current through the dynamically adjustable current source as a function of the output current.

34. The low dropout voltage regulation circuit of claim 25 wherein in the low dropout voltage regulation circuit further comprises:

a gain amplification stage having an input connected to the output of the differential comparison circuit for amplifying the drive signal; and a fast feedback coupling capacitor having a first terminal connected to the input of the gain amplification stage and a second terminal connected to the output terminal of the low dropout voltage regulation circuit to feed back changes in the output voltage level of the low dropout voltage regulation circuit to the input of the gain amplification stage.

35. The low dropout voltage regulation circuit of claim 34 wherein the low dropout voltage regulation circuit further comprises a buffer circuit having an input connected to the output of the gain amplification stage and an output connected to the input terminal of the follower drive transistor to condition the amplified drive signal and to provide a current mirror for the follower drive transistor.

36. The low dropout voltage regulation circuit of claim 25 wherein the follower drive transistor has a common supply terminal connected to a pre-regulated voltage source for providing power to the follower drive transistor.

37. A method of operation of a low dropout voltage regulation circuit having dynamic control of an output voltage comprising:

maintaining the voltage regulation circuit at a quiescent state to conserve energy;

receiving a request for modification of the output voltage of the voltage regulation circuit;

increasing a load current of an adjustable internal load circuit of the low dropout voltage regulation circuit to increase the bandwidth of the low dropout voltage regulation circuit;

sensing the increasing of the internal load current and transferring a sense signal to the first amplification circuit to cause the first amplification signal to increase the bandwidth of the first amplification circuit and thus the internal bandwidth of the low dropout voltage regulation circuit to allow rapid adjustment of the output voltage of the low dropout voltage regulation circuit;

commanding that a voltage adjustment circuit of the low dropout voltage regulation circuit modify the output voltage of the low dropout voltage regulation circuit; and commanding the adjustable internal load circuit to be disabled or decreased.

38. The method of operation of a low dropout voltage regulation circuit of claim 37 wherein the voltage adjustment circuit adjusts an adjusted reference voltage to a first input of a first amplification circuit of the low dropout voltage regulation circuit such that the output of the first amplification circuit is changed to cause the output terminal of a follower output transistor to change the output voltage.

* * * * *